US005204994A

United States Patent [19]

Herzberg et al.

[11] Patent Number: 5,204,994

[45] Date of Patent: Apr. 27, 1993

[54] SKULL-CAP/CLIP-RETAINER COMBINATION

[76] Inventors: Richard P. Herzberg; Sue Ellen D. Herzberg, both of 845 Quail Point Cove, Virginia Beach, Va. 23454

[21] Appl. No.: 860,426

[22] Filed: Mar. 30, 1992

[51] Int. Cl.[5] ..... A42B 7/00

[52] U.S. Cl. ..... 2/199; 132/61

[58] Field of Search ..... 2/181, 181.6, 181.8, 2/182.1, 182.3, 182.4, 182.7, 182.8, 185 R, 198, 199, 207, 195, 175; 132/61

[56] References Cited

U.S. PATENT DOCUMENTS

| | | | |
|---|---|---|---|
| 534,989 | 3/1895 | Astrich | 132/61 |
| 550,012 | 11/1895 | Astrich | 132/61 |
| 608,710 | 8/1898 | Piesbergen | 132/61 |
| 852,125 | 4/1907 | Levison | 132/61 |
| 895,500 | 8/1908 | Scanlan | 132/61 |
| 1,011,394 | 12/1911 | Wilson | 132/61 |
| 1,054,648 | 2/1913 | Keplinger | 132/57.1 |
| 1,364,669 | 1/1921 | Winch | 2/175 |
| 1,566,891 | 8/1924 | Lyon | 132/59 |
| 2,157,835 | 5/1939 | Solomons | 132/61 |
| 2,255,611 | 9/1941 | Brown | 132/61 |
| 3,474,798 | 5/1968 | Tillotson | 132/53 |
| 4,155,370 | 5/1979 | Nemoto | 132/53 |
| 5,138,720 | 8/1992 | Campbell | 2/207 |

*Primary Examiner*—Clifford D. Crowder
*Assistant Examiner*—Diana L. Biefeld
*Attorney, Agent, or Firm*—Griffin, Butler, Whisenhunt & Kurtossy

[57] ABSTRACT

A skull-cap/clip-retainer combination (10) comprises a skull-cap main shell (16) having clip-retainer pockets (24, 26) attached to an interior surface (20) thereof, each pocket having a wall (28) defining a pocket cavity (30) and a mouth (32) directed substantially toward a peripheral outer edge (22) of the main shell, and an elongated, bistable, spring, clip retainer (14) having first and second legs (34, 36) coupled together. In an open stable attitude of the clip retainer the legs are spread apart, but in a closed stable attitude the legs are closer together. The clip retainer is of a size and shape such that at least a first leg thereof fits into the clip-retainer pocket cavity through the mouth thereof when the clip retainer is slid along a person's head from the outer edge into the interior of the skull cap in an open attitude. The clip retainer can then be forced into the closed stable attitude with the first and second legs clamped onto hair and the wall of the clip-retainer pocket.

8 Claims, 1 Drawing Sheet

SKULL-CAP/CLIP-RETAINER COMBINATION

BACKGROUND OF THE INVENTION

This invention relates mainly to hats or caps and more particularly to, skull caps, yarmulkas, or other beanie-shaped hats which are positioned on the tops of wearers' heads and which do not extend downwardly to the sides of the heads.

Those who wear skull-cap type hats have the problem that the hats are difficult to retain on their heads. In this regard, women and others who wear small hats on the tops of their heads often use pins for holding them there. That is, a wearer will often extend a pin or needle through a shell of such a hat into the interior thereof, about hair from the wearer's head in the interior and then back through the hat shell again. Thus, the hair of the wearer serves to hold the hat on the wearer's head. Although such a method works adequately if a hat is relatively fancy so that the needle can be easily hidden, it does not work particularly well for a plain skull cap or a yarmulka, because not only can it be seen by others, it also tends to deform the shell of the hat which, again, can be seen by others, both of which detract from the appearance thereof.

Many people who frequently wear yarmulkas employ elongated, bistable, spring, clip retainers for holding them on their heads. In this regard, such an elongated clip retainer has first and second legs coupled together which can be placed in an open stable attitude of the clip retainer, with its legs spread apart, but which can also be forced into a closed stable attitude of the clip retainer with the legs close together. Such a prior-art bistable clip retainer is identified as element 14 in the drawings hereof. Basically, this elongated, bistable, spring, clip retainer is used in the prior art by placing the clip retainer in an open stable attitude and sliding the clip retainer onto a peripheral outer edge of a yarmulka on a person's head with a first leg on the exterior of the yarmulka and a second leg on the interior of the yarmulka. As the clip retainer is slid onto the peripheral outer edge of the yarmulka the second leg "catches" hair. Once the clip retainer is fully slid onto the peripheral outer edge of the yarmulka the first and second legs are forced together and the clip retainer is bowed to the closed stable attitude in which the first and second legs are close together, thereby clamping the wearer's hair to the interior of the yarmulka for anchoring the yarmulka. Although such an arrangement holds a yarmulka on a wearer's head quite nicely, the clip retainer can be seen extending below the peripheral outer edge of the yarmulka and the first leg of the clip retainer can be seen on the exterior thereof, both of which are somewhat annoying aesthetically.

It is an object of this invention to provide a skull-cap/clip-retainer combination which can be easily manipulated to hold a skull cap thereof on a wearer's head with a clip retainer thereof not being substantially visible to others.

It is a further object of this invention to provide a skull cap which is uniquely adapted for use with a prior-art clip retainer to be securely held on the head of a wearer without the clip retainer being substantially visible to others.

It is yet another object of this invention to provide a method for holding a hat on the head of a wearer with a clip retainer without the clip retainer being substantially visible to others.

SUMMARY OF THE INVENTION

According to principles of this invention, a skull cap includes a main shell having a clip-retainer pocket attached to an interior surface thereof with the clip-retainer pocket having a wall defining a pocket cavity with a mouth directed substantially toward, and being close to, a peripheral outer edge of the skull cap. An elongated, bistable, spring, clip retainer, comprising first and second legs coupled together which in an open stable attitude thereof are substantially spread apart but which in a closed stable attitude are relatively close together, is of a size and shape such that at least the first leg of the clip retainer fits into the clip-retainer pocket cavity through the mouth thereof. The skull cap is secured on a wearer's head by sliding the clip retainer along the wearer's head from the peripheral outer edge into the interior of the skull cap in an open attitude with the first leg entering the pocket and with hair from the wearer's head relatively moving between the first and second legs. The clip retainer is then forced to the closed stable attitude with the first and second legs clamped close to one another on the hair and the wall of the clip-retainer pocket to hold the skull cap on the wearer's head. In a preferred embodiment, there are two such pockets and two clip retainers on one skull cap.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
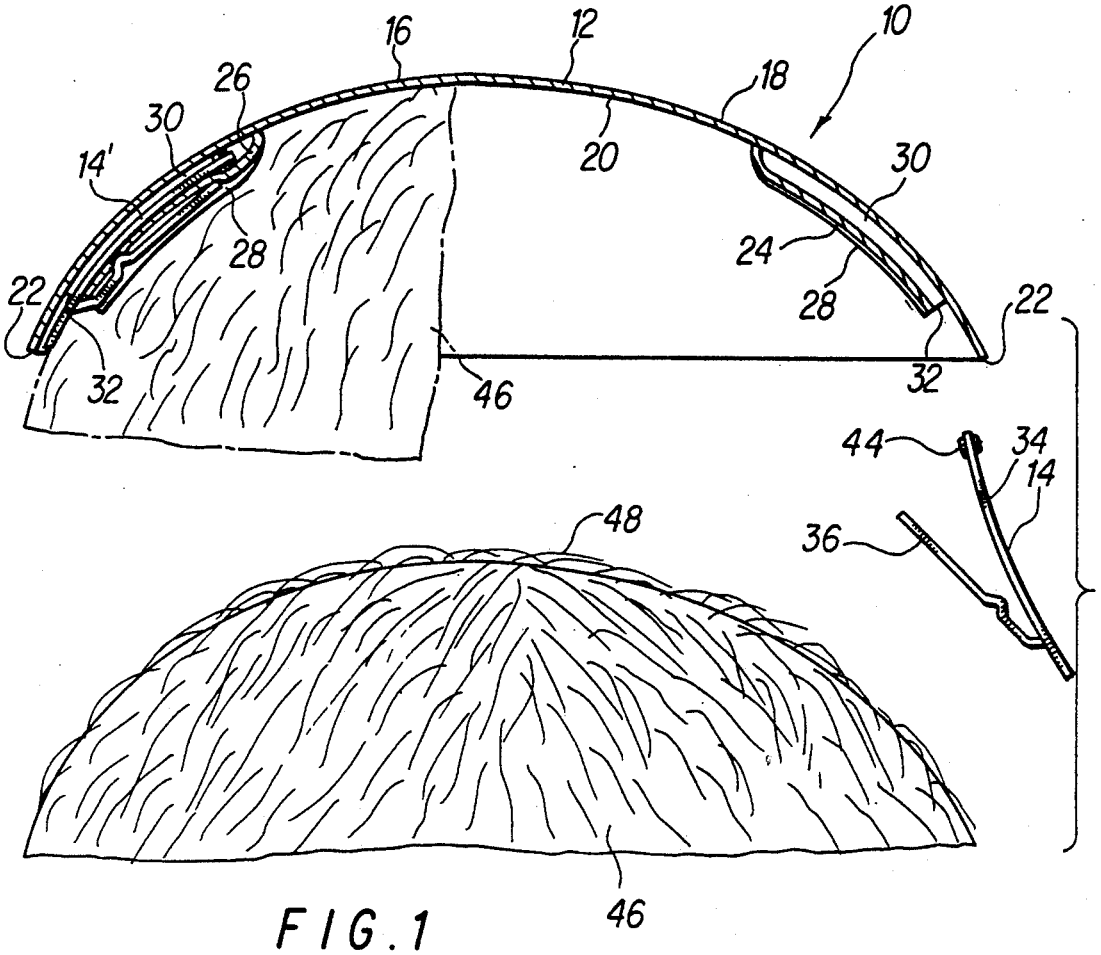
FIG. 1 is an exploded side view of a skull-cap/clip-retainer combination of this invention with the skull cap thereof being shown in cross section as it is about to be placed on a wearer's head.

A skull-cap/clip-retainer combination 10 comprises mainly a skull cap 12 and a clip retainer 14.

The skull cap 12 can be of many various types and can have many various purposes as is described above. Basically, the skull cap 12 comprises a bowl-shaped main shell 16 of a flexible cloth material, such as cotton, wool, or any other natural or synthetic cloth material, having an outer surface 18, an interior surface 20, and defining a peripheral outer edge 22. Attached to the main shell 16 on the interior surface thereof are two clip-retainer pockets 24 and 26, each formed of a wall 28 attached to the main shell 16 at portions thereof lying on the wearer's head to form a pocket cavity 30, which is basically defined by the wall 28 and the main shell 16, having a mouth 32 opening toward, and being close to, the peripheral outer edge 22.

Figure 2:
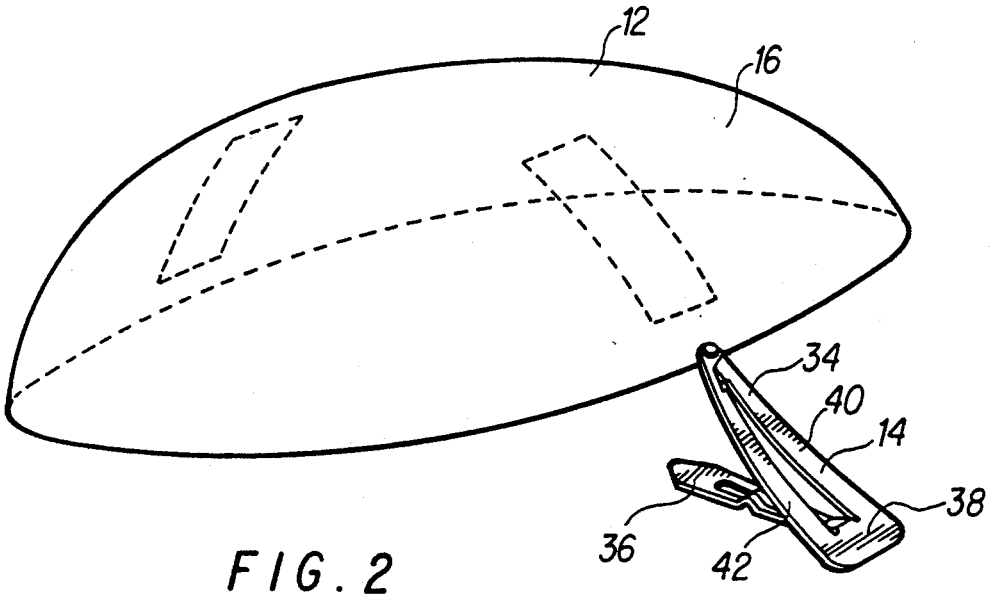
FIG. 2 is an isometric view of a skull-cap/clip-retainer combination of this invention in a slightly modified embodiment thereof.

The clip retainer 14, which is a type commonly sold, has a first leg 34 and a second leg 36 which are attached together at a base 38. The first leg 34 is formed of two prongs 40 and 42 whose free ends are flexed together and attached together by a rivet 44. In a preferred embodiment, the clip retainer 14 is constructed of a single piece of spring steel (other than the rivet 44), however, it may be possible to also construct it of plastic. In any event, the inward flexing of the prongs 40 and 42 causes the clip retainer 14 to have two stable attitudes. In an open attitude the first and second legs 34 and 36 are spread apart as shown in FIG. 2 with the first leg 34 thereof being bowed, or curved, away from the second leg 36. To move the clip retainer to a closed attitude, the first leg 34 is forced to be bowed in the opposite direction, toward the second leg 36, as is the retainer clip 14' on the left side of FIG. 1. The first and second legs 34 and 36 then press toward one another, thereby clamping anything that is placed between these legs. The clip retainer 14 is stable in both the open and the closed attitudes, so that it can be "snapped" between these two attitudes.

To secure the skull cap 12 on a wearer's head 46 the skull cap 12 is placed on the wearer's head 46 with the concave interior surface 20 thereof having a shape which approximately conforms to the contour of the wearer's head. The wearer places the clip retainers 14 and 14' into the open attitude, with the first and second legs 34 and 36 thereof being spread apart, and sequentially inserts each of the clip retainers 14 and 14' into the interior of the skull cap 12 from the peripheral outer edge 22 thereof with the first leg 34 entering the respective pocket cavity 30 of each of the clip-retainer pockets 24 and 26. As each of the clip retainers 14 is so inserted below the skull cap 12 in the open attitude, hair 48 on the wearer's head 46 is automatically relatively positioned between the first and second legs 34 and 36 as is the respective wall 28 of each of the clip-retainer pockets 24 and 26. Once the clip retainer 14 or 14' is fully inserted with the base 38 thereof being substantially within the peripheral outer edge 22, or at least not extending significantly therebelow, the wearer applies pressure to the first and second legs 34 and 36 of the clip retainer to force the clip retainer to reverse its bow so that the concave side thereof is facing the wearer's head. This forces the clip retainer 14 into the closed attitude of clip retainer 14 or 14' in which the first and second legs 34 and 36 are moved close to one another (see clip retainer 14' in FIG. 1), thereby clamping the hair 48 and the wall 28 of the respective clip-retainer pocket 24 or 26 between the first and second legs 34 and 36. Thus, the skull cap 12 is now firmly anchored by means of the hair 48 to the wearer's head 46.

It can be appreciated by those skilled in the art that the skull-cap/clip-retainer combination of this invention, and its method of use, provide an uncomplicated manner of securing a skull cap to a wearer's head with a retainer clip without the retainer clip being visible, or aesthetically displeasing, to others.

At the same time, because the retainer clips are each in a concave configuration substantially conforming to the contour of a wearer's head, the main shell 16 of the skull cap 12 is not substantially changed or deformed thereby avoiding disturbing, aesthetically displeasing features.

While the invention has been particularly shown and described with reference to a preferred embodiment, it will be understood by those skilled in the art that various changes in form and detail may be made therein without departing from the spirit and scope of the invention. In this regard, with reference to FIG. 2, in one embodiment an additional cloth loop on the interior surface 20 of the main shell 16, at the peripheral outer edge 22 thereof, surrounds one of the prongs 40 or 42 so that the clip retainer 14 is not completely removable from the main shell 16 of the skull cap 12, but yet is still slidable relative to it so that the first leg can be slid into and out of its clip-retainer pocket. This embodiment has the benefit that a wearer can easily find the clip-retainer pocket for inserting the first leg 34 into its pocket cavity, because the first leg 34 is guided thereinto by this circular loop. In one embodiment the cloth loop can actually be the pocket.

Also, it should be appreciated that each clip-retainer pocket 24 and 26 need not be closed at an interior end thereof, but rather could be an open band which forms a pocket cavity into which the first leg 34 can extend. Also, the wall 28 of the clip-retainer pocket need not be of a cloth material, but rather could be of a more rigid material, again, so that it can be more easily found by a wearer when inserting the first leg of the clip retainer into the pocket cavity. However, the more rigid the wall 28 is, the more likely that it will cause an aesthetically adverse pulling, or deforming, of the main shell 16. The size of the clip-retainer pocket should be such that the pocket cavity will tightly receive the first leg 34 of the clip retainer, however, it may be quite a bit larger. However, if the pocket cavity becomes too large, the main shell is not held tightly on the wearer's head which is detrimental.

It would be possible to include a radially outwardly extending hat brim at the peripheral outer edge 22 of the main shell 16, which is an advantage of this invention. That is, in the prior art the clip retainer used in this invention could only be used with simple skull-cap shells.

It would be possible to construct the pockets separately from the skull cap and adhere them into the interior of the skull cap.

The embodiments of the invention, in which an exclusive property or privilege are claimed, are defined as follows:

1. A combination skull-cap/clip-retainer comprising:

a skull cap for covering a wearer's head, said skull cap including a main shell defining an interior surface and a peripheral outer edge, said skull cap having a shape such that it fits on a wearer's head, the wearer's head being in the interior thereof, with a portion of said interior surface lying on the wearer's head, said skull cap further comprising a clip-retainer pocket attached to the interior surface of said skull cap, said clip-retainer pocket having a wall defining a pocket cavity with a mouth directed substantially toward said peripheral outer edge;

an elongated, spring, clip retainer comprising first and second legs coupled together which, in an open attitude, are substantially spread apart, but which, in a closed attitude, are relatively closer together, said spring, clip retainer being of a size and shape such that at least said first leg of said clip retainer fits into said clip-retainer pocket cavity through the mouth thereof;

whereby, said skull cap can be placed on a wearer's head, said clip retainer can be slid under said main shell along the wearer's head from said outer edge into the interior of said skull cap in said open attitude with said first leg sliding in said pocket and with hair from said wearer's head relatively moving between said first and second legs, and said clip retainer can then be changed into said closed attitude with said first and second legs clamped on said hair and said wall of said clip-retainer pocket between said legs to hold said skull cap on said head.

2. A combination as in claim 1 wherein there are two pockets and two clip retainers which are positioned on opposite sides of the skull cap.

3. A combination as in claim 1 wherein the clip retainer is in a bowed attitude when in the closed attitude, said bowed attitude approximately corresponding to a curve of a wearer's head.

4. A combination as in claim 1 wherein said clip retainer is slidably coupled to the skull cap so that it can be slid relative to the main shell, but it is not totally removable therefrom.

5. A combination as in claim 1 wherein said clip-retainer pocket is attached to said interior surface at said portion lying on a wearer's head.

6. A combination as in claim 1 wherein said mouth of said pocket cavity is spaced from said peripheral outer edge of said main shell a sufficient distance for allowing substantially all of said clip retainer to be positioned under said main shell when it is fully inserted into said clip retainer pocket.

7. A combination as in claim 1 wherein said clip retainer is a bistable clamp in which each of said open and closed attitudes is a stable attitude, with said clip retainer being bowed in said closed attitude to correspond to the shape of a wearer's head.

8. A method of retaining a skull cap on a wearer's head comprising the steps of:

providing a skull cap including a main shell defining an interior surface in an interior thereof and a peripheral outer edge, said skull cap having a shape such that it fits on the wearer's head, the wearer's head being in the interior thereof, with a portion of said interior surface lying on the wearer's head, said skull cap further comprising a clip-retainer pocket attached to the interior surface, said clip-retainer pocket having a wall defining a pocket cavity with a mouth directed substantially toward said peripheral outer edge;

placing said skull cap on a wearer's head;

providing an elongated spring clip retainer having first and second legs coupled together, which in an open stable attitude of the clip retainer are substantially spread apart but which in a closed stable attitude thereof are relatively closer together, said clip retainer being of a size and shape such that at least the first leg thereof fits into said clip-retainer pocket cavity through the mouth thereof sliding said clip into the interior of said main shell from said peripheral outer edge thereof into said pocket cavity while simultaneously engaging hair on the wearer's head between said first and second legs for thereby anchoring the skull cap to the wearer's head with said hair, wherein during said step of sliding said elongated clip retainer into the interior of said main shell, said clip retainer is in said open stable attitude and the first leg is slid into said clip-retainer pocket; and once said clip retainer is inserted into said pocket cavity, moving the clip retainer into said closed stable attitude of the clip retainer to thereby clamp wearer's hair and the wall of the clip-retainer pocket between the first and second legs thereof.

* * * * *